US006638033B2

(12) United States Patent
Wang

(10) Patent No.: US 6,638,033 B2
(45) Date of Patent: Oct. 28, 2003

(54) MAGNETIC-LEVITATED COOLING CIRCULATORY MECHANISM

(75) Inventor: Chin-Wen Wang, 4F-3, No. 9, Hsin Fu I St., Ping Jen City, Tao Yuan Hsien (TW)

(73) Assignees: Chin-Wen Wang, Tao Yuan Hsien (TW); Pei-Choa Wang, Tao Yuan Hsien (TW); Ching Chung Wang, Tao Yuan Hsien (TW)

( * ) Notice: Subject to any disclaimer, the term of this patent is extended or adjusted under 35 U.S.C. 154(b) by 5 days.

(21) Appl. No.: 10/107,263

(22) Filed: Mar. 28, 2002

(65) Prior Publication Data

US 2003/0185689 A1 Oct. 2, 2003

(51) Int. Cl.[7] ..... F04B 17/00; H05K 7/20

(52) U.S. Cl. ..... 417/356; 417/420; 361/697; 62/259.2; 165/80.3

(58) Field of Search ..... 417/356, 420, 417/423.14; 361/695, 697; 62/259.2; 165/80.3, 121

(56) References Cited

U.S. PATENT DOCUMENTS 5,559,674 A * 9/1996 Katsui ..... 361/697
5,731,954 A * 3/1998 Cheon ..... 361/699
5,924,848 A * 7/1999 Izraelev ..... 417/420
6,175,495 B1 * 1/2001 Batchelder ..... 361/695
6,208,512 B1 * 3/2001 Goldowsky et al. ..... 361/699

* cited by examiner

*Primary Examiner*—Charles G. Freay
*Assistant Examiner*—Michael K. Gray
(74) *Attorney, Agent, or Firm*—Rosenberg, Klein & Lee

(57) ABSTRACT

The present invention relates to a cooling system specially used generated when a CPU of a desktop computer operates. The present invention provides a magnetic-levitated cooling circulatory mechanism, which comprises an outer ring heat spreader having a hollow position therein, a plurality of heat-radiating fins inside the outer ring heat spreader, a magnetic hollow cavity capable of slidably rotating in the hollow position of the outer ring heat spreader, and a magnetic windmill placed at one end of the outer ring heat spreader. The magnetic windmill is driven to rotate by a power source. When the magnetic windmill rotates, the magnetic hollow cavity can be attracted to rotate so as to quickly transfer heat source, thereby achieving the heat-radiating function of compulsory flow of fluid.

10 Claims, 9 Drawing Sheets

MAGNETIC-LEVITATED COOLING CIRCULATORY MECHANISM

FIELD OF THE INVENTION

The present invention relates to a magnetic-levitated cooling circulatory mechanism and, more particularly, to a cooling system specially used when a central processing unit (CPU) of a desktop computer operates. The magnetic-levitated cooling circulatory mechanism comprises an outer ring heat spreader formed of a cylindrical ring. Heat-radiating fins radially gather together from the outer ring heat spreader to the center. A fan and a magnetic windmill are also matched to assemble the magnetic-levitated cooling circulatory mechanism. A magnetic hollow cavity is enclosed in the annular wall of the outer ring heat spreader, and can slidably rotate inside the annular wall.

BACKGROUND OF THE INVENTION

Nowadays, every aspect of lives cannot come off the range of scientific technology. Scientific progress mainly shows in the invention of computer. Especially, the influence of central processing unit (CPU) in the computer has already totally permeated personal life.

Along with quick development of the computer industry, computers have more and more powerful operational capacity, and the operational speeds of CPUs become faster and faster. Moreover, the CPUs give out more and more heat. In order to let the CPUs operate under admissible temperatures, various kinds of heat radiators having increased heat-radiating areas have been proposed to apply to electronic parts giving out more heat like the CPUs.

However, the heat-radiating function of conventional heat-radiating fins can hardly solve the heat-radiating problem of heat source generated when the CPU operates with the operational speed thereof enhanced more and more.

As shown in FIG. 1, in a prior art desktop computer, a plurality of erect heat-radiating fins 2' are generally used for cooling of a CPU thereof. Heat source generated by the CPU 6 in the computer is spread from a bottom face 1' to the heat-radiating fins 2'. A fan 4 is also matched to radiate out heat.

As shown in FIG. 2, a plurality of heat-radiating fins 2" are circularly distributed with a central cylinder heat spreader 1" as the center. A fan 4 is also matched to accomplish the whole heat-radiating function.

However, because the one side of the heat-radiating fins opposite to the fan is a closed plane, the heat-radiating capacity in limited space is much restrained. Moreover, the prior art open-end heat-radiating fins are solid material, which spreads heat by means of heat conduction. Therefore, the heat-radiating speed is much slower than the speed at which heat is discharged by means of heat convection when the CPU operates. The heat-radiating efficiency thereof is thus not good enough.

Accordingly, the present invention aims to provide a magnetic-levitated cooling circulatory mechanism to resolve the problems in the prior art.

SUMMARY OF THE INVENTION

The primary object of the present invention is to provide a magnetic-levitated cooling circulatory mechanism, which concentratedly radiates out heat in a closed space. In addition to heat conduction between solid structures, heat-radiating function achieved by compulsory flow of fluid can also be obtained, thereby enhancing the heat-radiating function thereof. Moreover, the cost won't be too high because of the above enhanced function. Additionally, through the special structure of the present invention, heat can be effectively and totally radiated out of the computer in circulatory way and with increased heat-radiating area, hence increasing convenience and efficiency of the present invention.

To achieve the above object, the present invention provides a magnetic-levitated cooling circulatory mechanism, which comprises an outer ring heat spreader having a hollow position therein, a plurality of heat-radiating fins inside the outer ring heat spreader, a magnetic hollow cavity capable of slidably rotating in the hollow position of the outer ring heat spreader, and a magnetic windmill placed at one end of the outer ring heat spreader. The magnetic windmill is driven to rotate by a power source. When the magnetic windmill rotates, the magnetic hollow cavity can be attracted to rotate so as to quickly transfer heat source, thereby achieving heat-radiating function of compulsory flow of fluid.

The various objects and advantages of the present invention will be more readily understood from the following detailed description when read in conjunction with the appended drawing, in which:

DETAILED DESCRIPTION OF THE PREFERRED EMBODIMENTS

Figure 1:
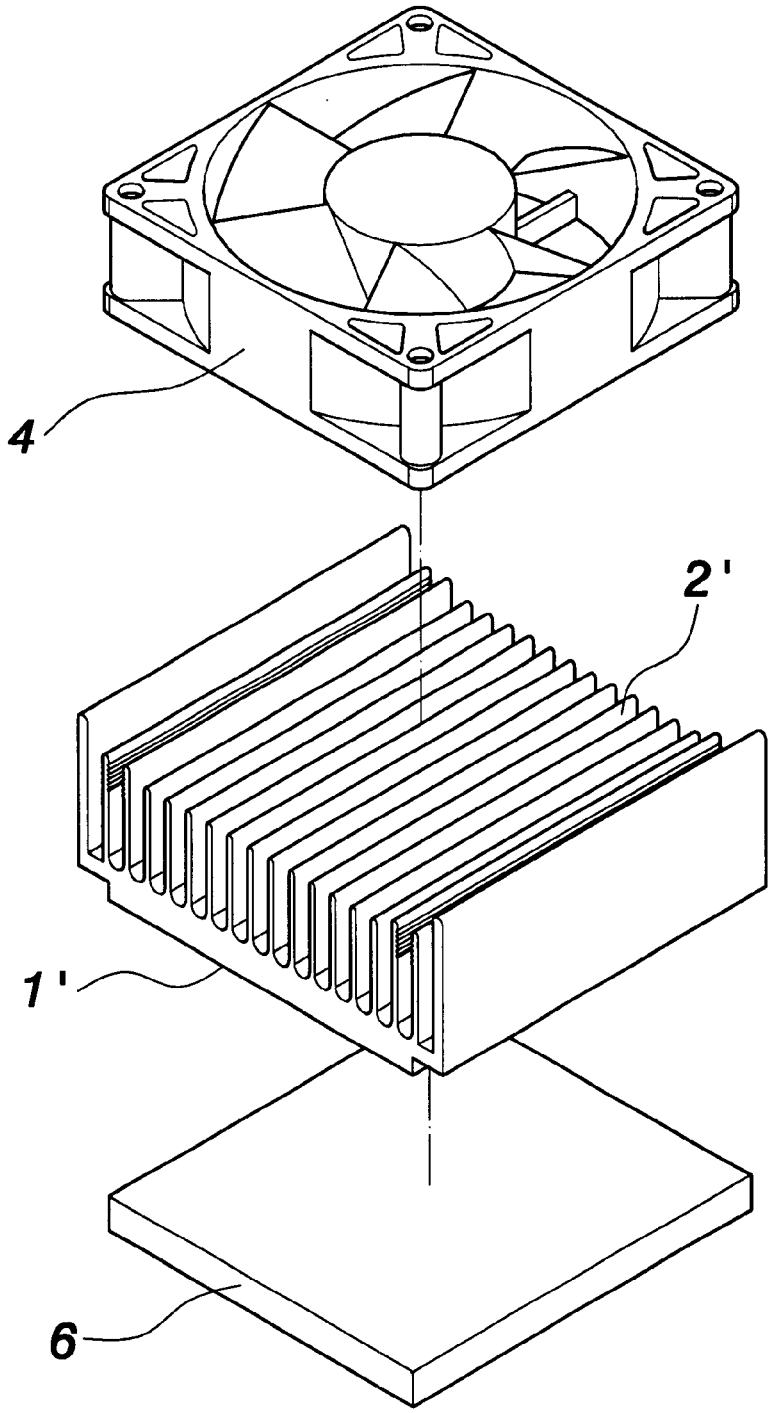
FIG. 1 PRIOR ART
FIG. 1 is a perspective view of heat-radiating subassemblies in the prior art.
Figure 2:
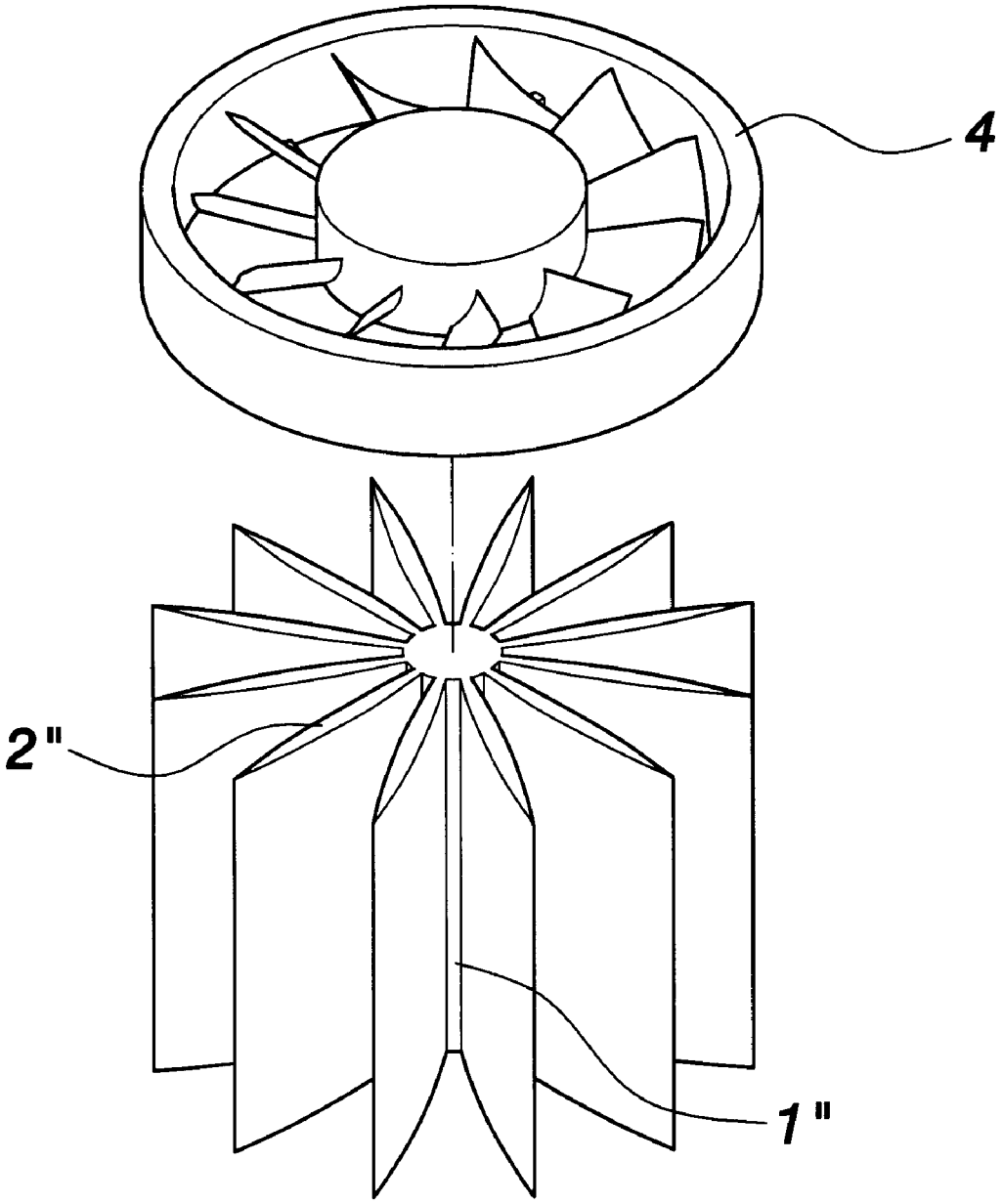
FIG. 2 PRIOR ART
FIG. 2 is a perspective view of another kind of heat-radiating subassemblies in the prior art.
Figure 3:
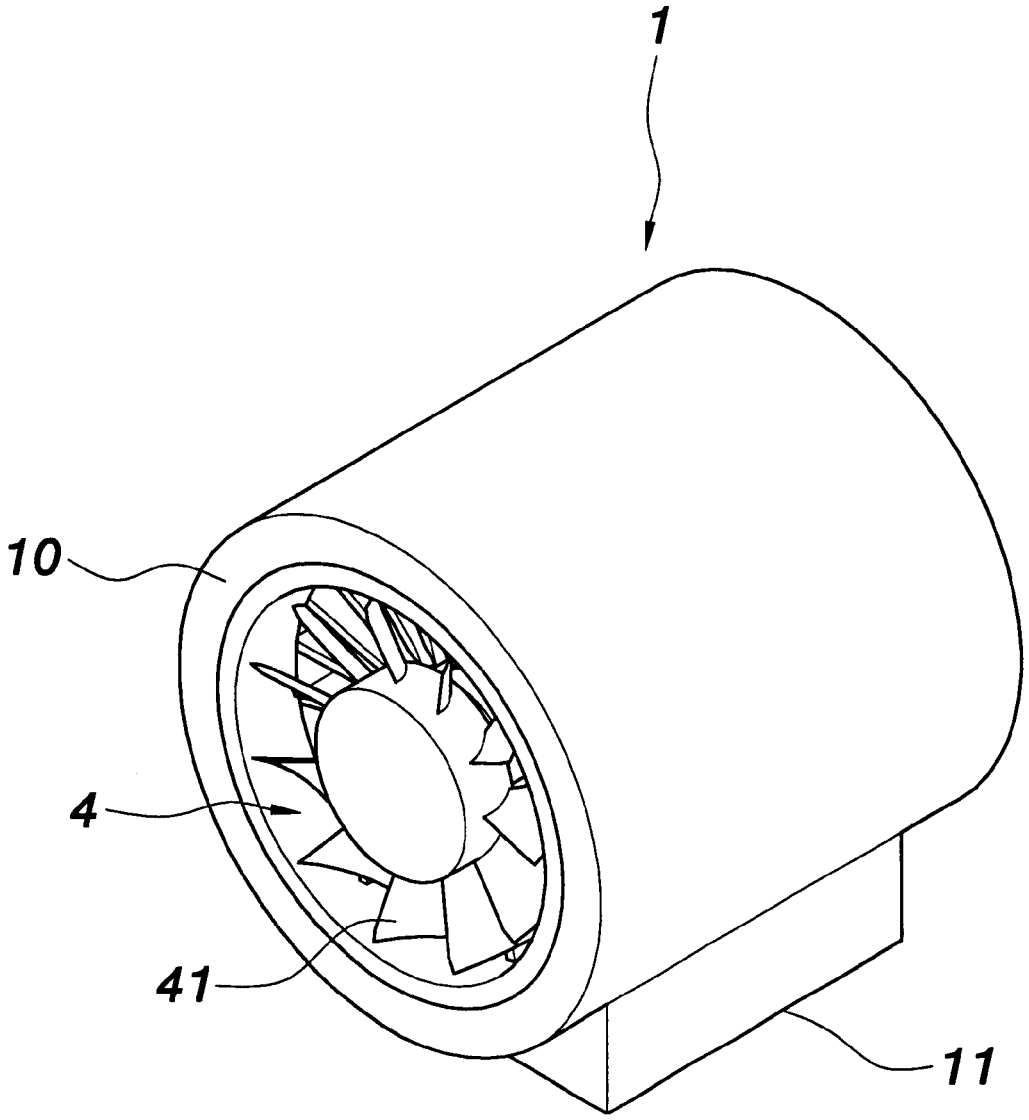
FIG. 3 is a perspective view of the present invention.
Figure 4:
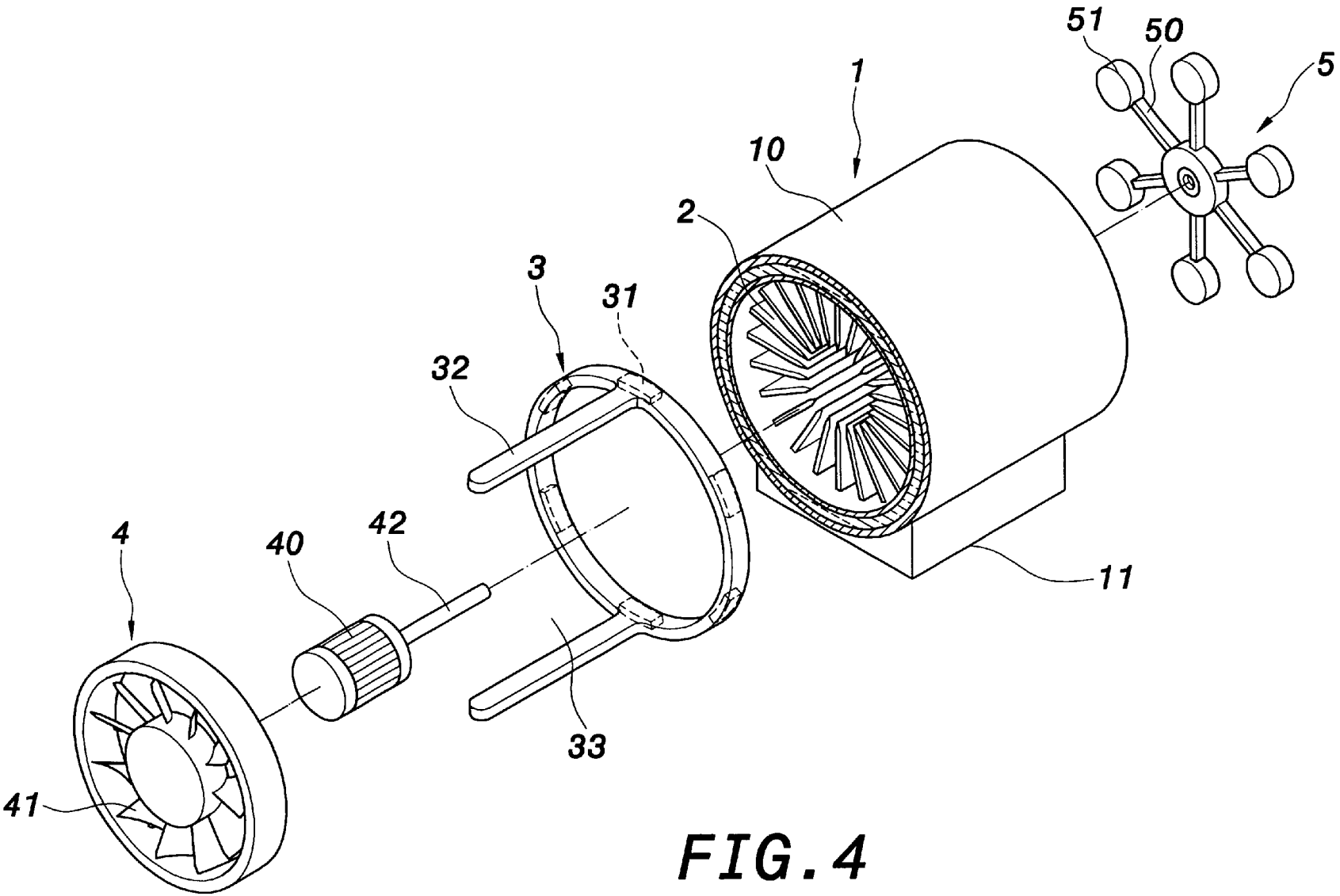
FIG. 4 is an exploded perspective view of the present invention.
Figure 5:
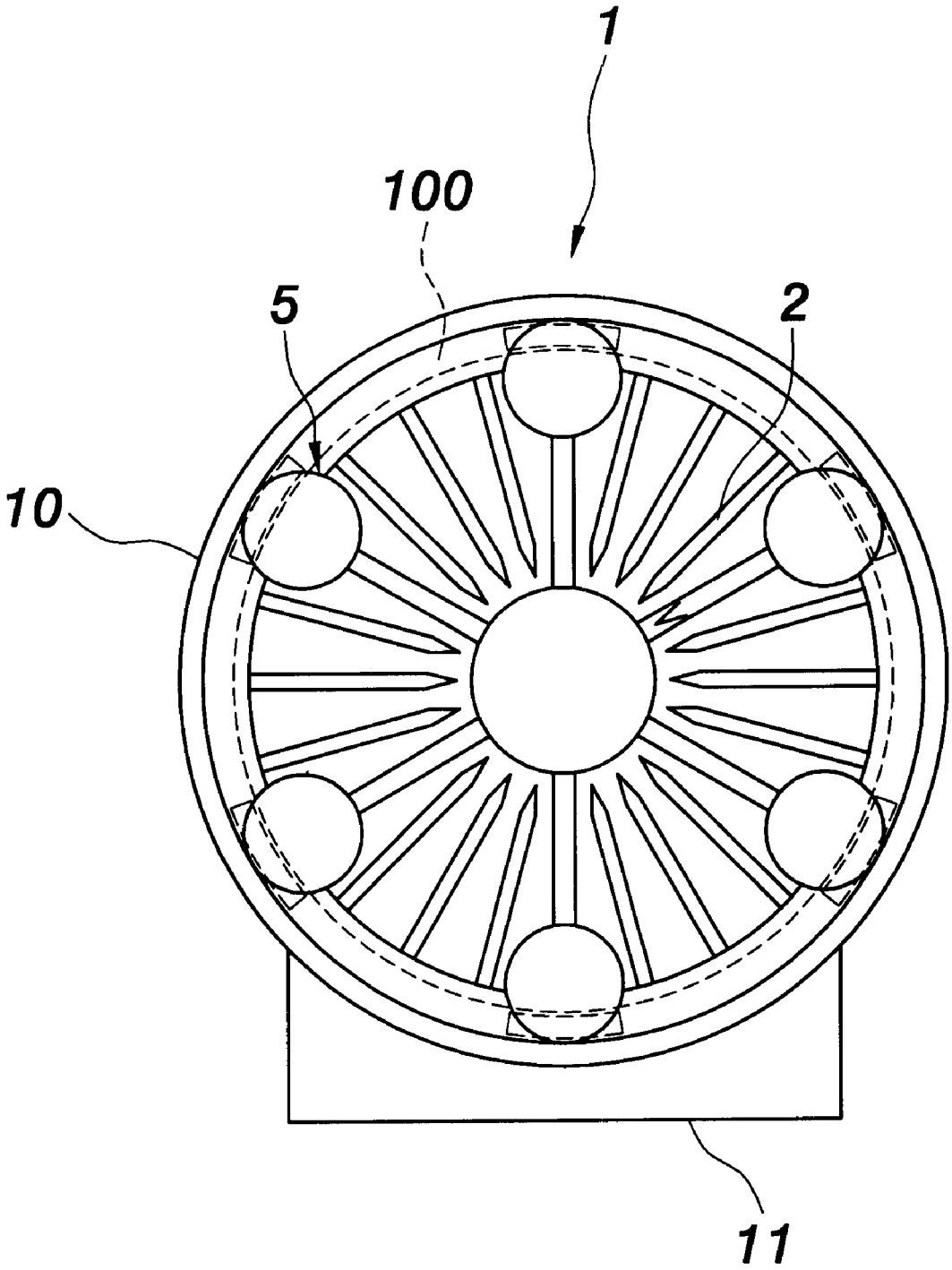
FIG. 5 is a front view of the present invention.

As shown in FIGS. 3 to 7, the present invention provides a magnetic-levitated cooling circulatory mechanism, which comprises an outer ring heat spreader 1, a plurality of heat-radiating fins 2, a magnetic hollow cavity capable of slidably rotating inside the inner wall of the outer ring heat spreader 1. A fan 4 and a magnetic windmill 5 are also matched to assemble the magnetic-levitated cooling circulatory mechanism, which is placed above a CPU 6. Rotary action between solid structures generates circulation to radiate out heat source generated when the CPU operates.

The outer ring heat spreader 1 is made of material of good heat conductance, and comprises a seat bottom face 11 and an annular wall 10. The annular wall 10 is formed of a cylindrical ring. The inner edge of the annular wall 10 has a hollow receiving space, which penetrates to two ends of the outer ring heat spreader 1. A hollow position 100 is also provided in the annular wall 10.

The heat-radiating fins 2 are at about the central region in the receiving space of the outer ring heat spreader 1. The heat-radiating fins 2 project from the inner wall of the outer ring heat spreader 1, and radially gather together toward the center of the outer ring heat spreader 1. In this embodiment, the heat-radiating fins are in radial form, but are limited to this kind of design, and can make other proper and effective changes.

The magnetic hollow cavity 3 is integrally formed, and is placed at the hollow position 100 and attached to the annular wall 10 of the outer ring heat spreader 1. A plurality of magnets 31 are disposed at one end of the hollow cavity 3 to let it have magnetism. The hollow cavity has one or a plurality of rod bodies 32 having stirring function. A hollow space 33 is formed between the rod bodies 32 so the magnetic hollow cavity 3 has the hollow space 33 therein. The hollow cavity 3 can freely slide in the hollow position 100 inside the annular wall 10 so that the hollow cavity 3 can rotate with the center of the annular wall 10 as the axis. The hollow position 100 can be filled with heat-spreading material or cooling liquid to enhance heat-spreading and cooling function of the outer ring heat spreader 1.

The fan 4 is plugged in and fixedly placed at one end of the inner face of the annular wall 10 of the outer ring heat spreader 1. The fan 4 has blades 41. An internal motor thereof (not shown) is used to drive the blades 41 to rotate for generating airflow.

The magnetic windmill 5 is placed in the other end of the annular wall 10 of the outer ring heat spreader 1. The center of the magnetic windmill 5 can be connected to a pivot 42 of a motor 40 for power output so that the motor 40 can be used to form a power source for driving the magnetic windmill to rotate. The magnetic windmill 5 has a plurality of blades 50, each having a magnet 51 thereon. The magnets 51 correspond with the magnets 31 of the hollow cavity 3. A magnetic-levitated cooling circulatory mechanism of the present invention is thus formed.

Figure 6:
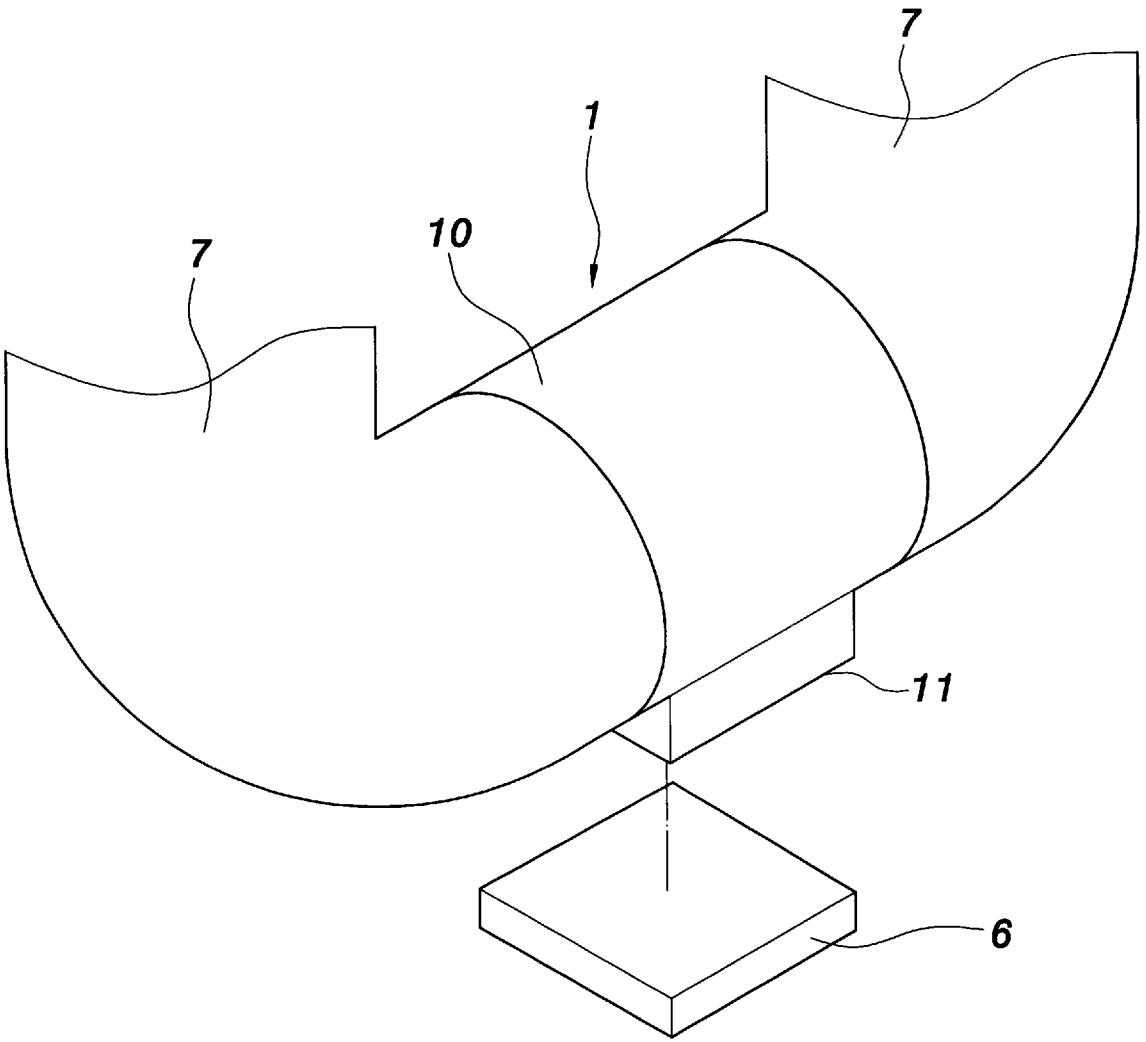
FIG. 6 is a perspective view showing the use state of the present invention.
Figure 7:
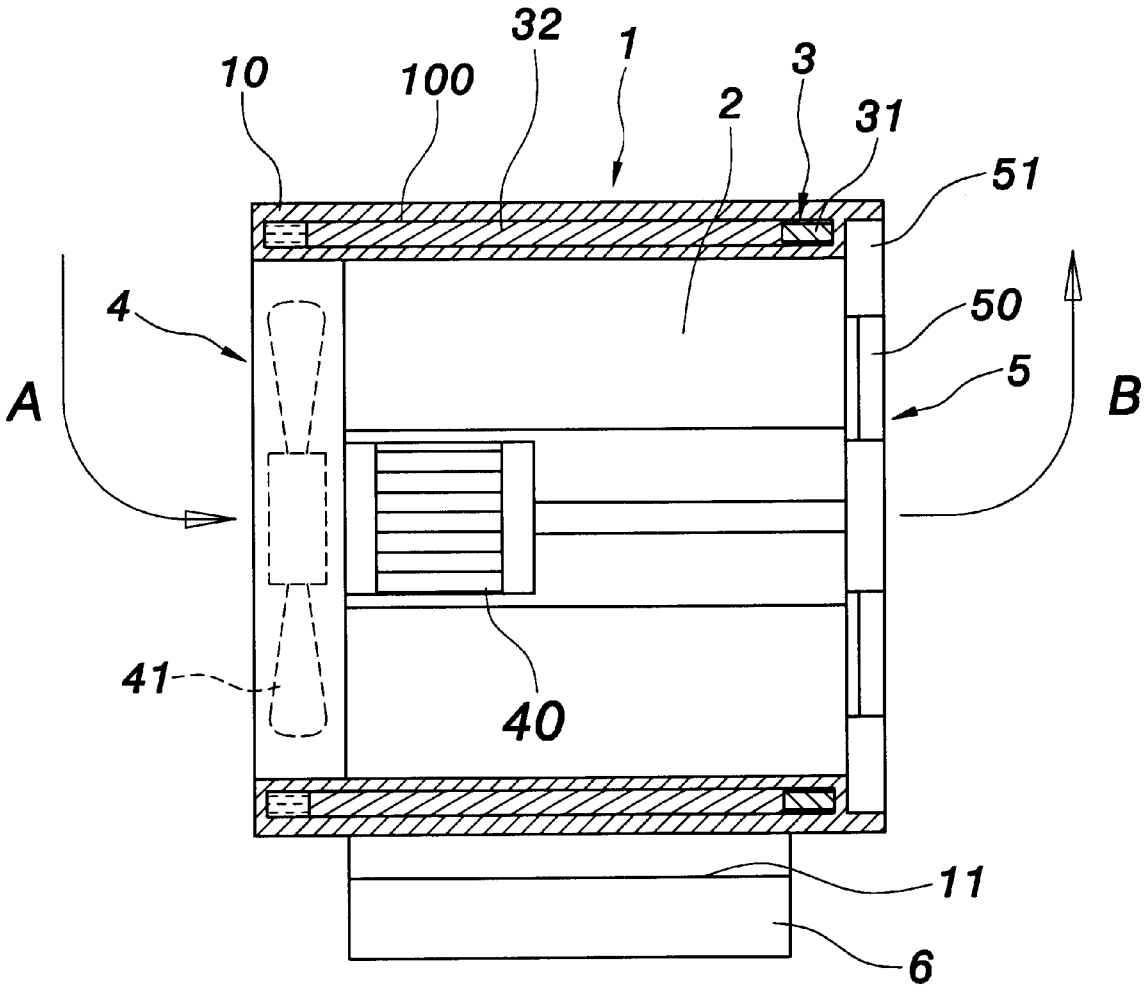
FIG. 7 is a cross-sectional view showing the use state of the present invention.

Please refer to FIGS. 6 and 7. Predetermined heat-spreading pipes 7 can be connected at two ends of the outer ring heat spreader 1. Heat source generated when the CPU 6 operates is conducted to the annular wall 10 via the seat bottom face 11 of the outer ring heat spreader 1. Rotation of the fan 4 generates airflow to help the heat-radiating fins 2 radiating out heat. Simultaneously, the motor 40 can drive the magnetic windmill 5 to rotate via the pivot 42. The magnets 51 on the blades 50 of the windmill 5 will also rotate to attract the magnets 31 of the hollow cavity 3, which will thus be driven to rotate with the center of the annular wall 10 as the axis. The rod bodies 32 of the hollow cavity 3 can stir the heat-spreading material or cooling fluid in the hollow position 100 so the heat source generated by the CPU 6 can be quickly transferred. Residual heat will spread to the heat-radiating fins 2 by means of circulation similar to heat convection.

Rotation of the blades 41 of the fan 4 can further enhance flow of air through the heat-radiating fins 2, hence driving hot air and cold air to generate compulsory flow. Cold air enters from direction A, while hot air flows out in direction B. Compulsory flow of cold and hot air will enhance heat-radiating function. Moreover, through the special structure of the present invention, heat can be effectively and totally radiated out of the computer in circulatory way and with increased heat-radiating area, hence increasing convenience and efficiency of the present invention.

Figure 8:
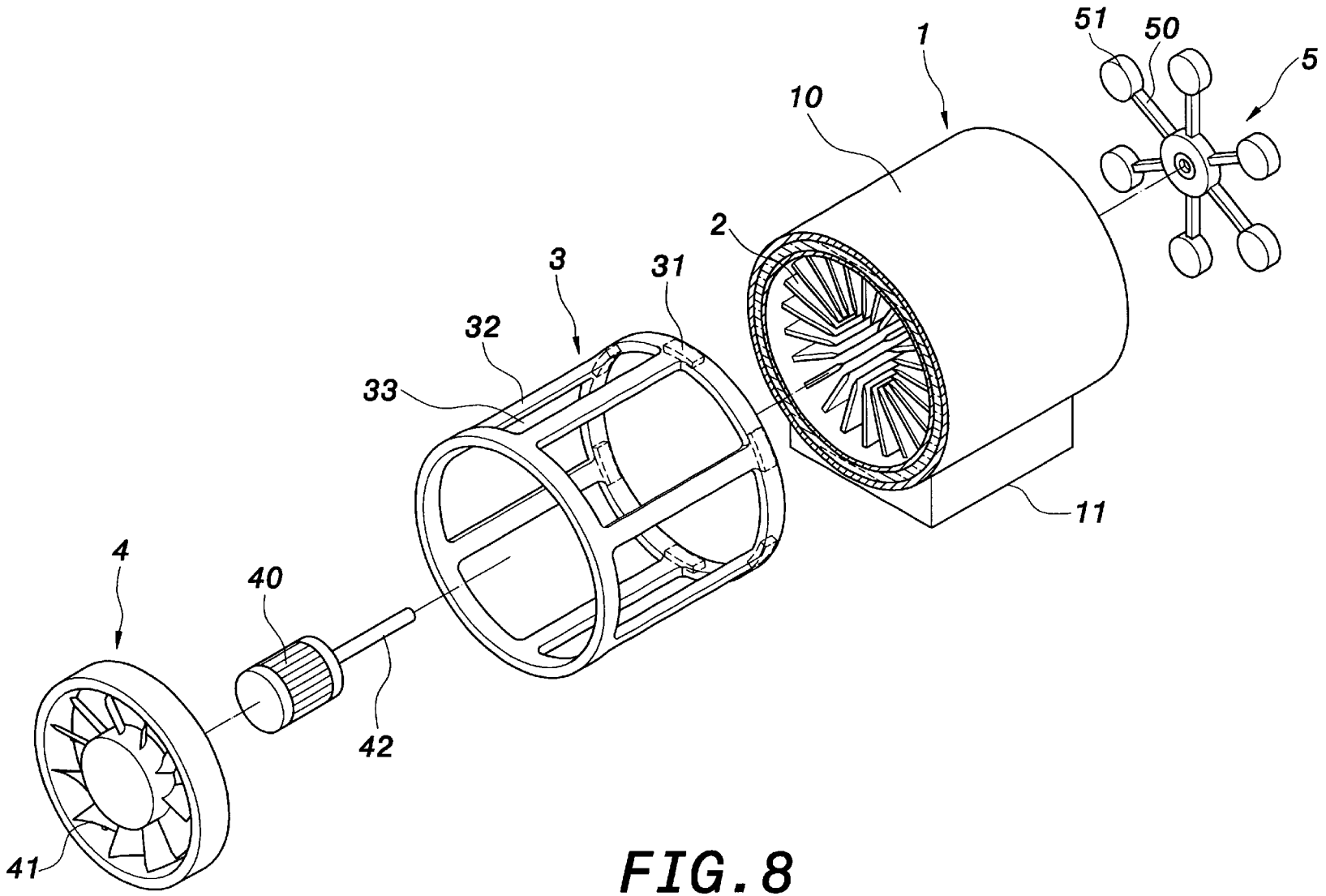
FIG. 8 is an exploded perspective view according to another embodiment of the present invention.
Figure 9:
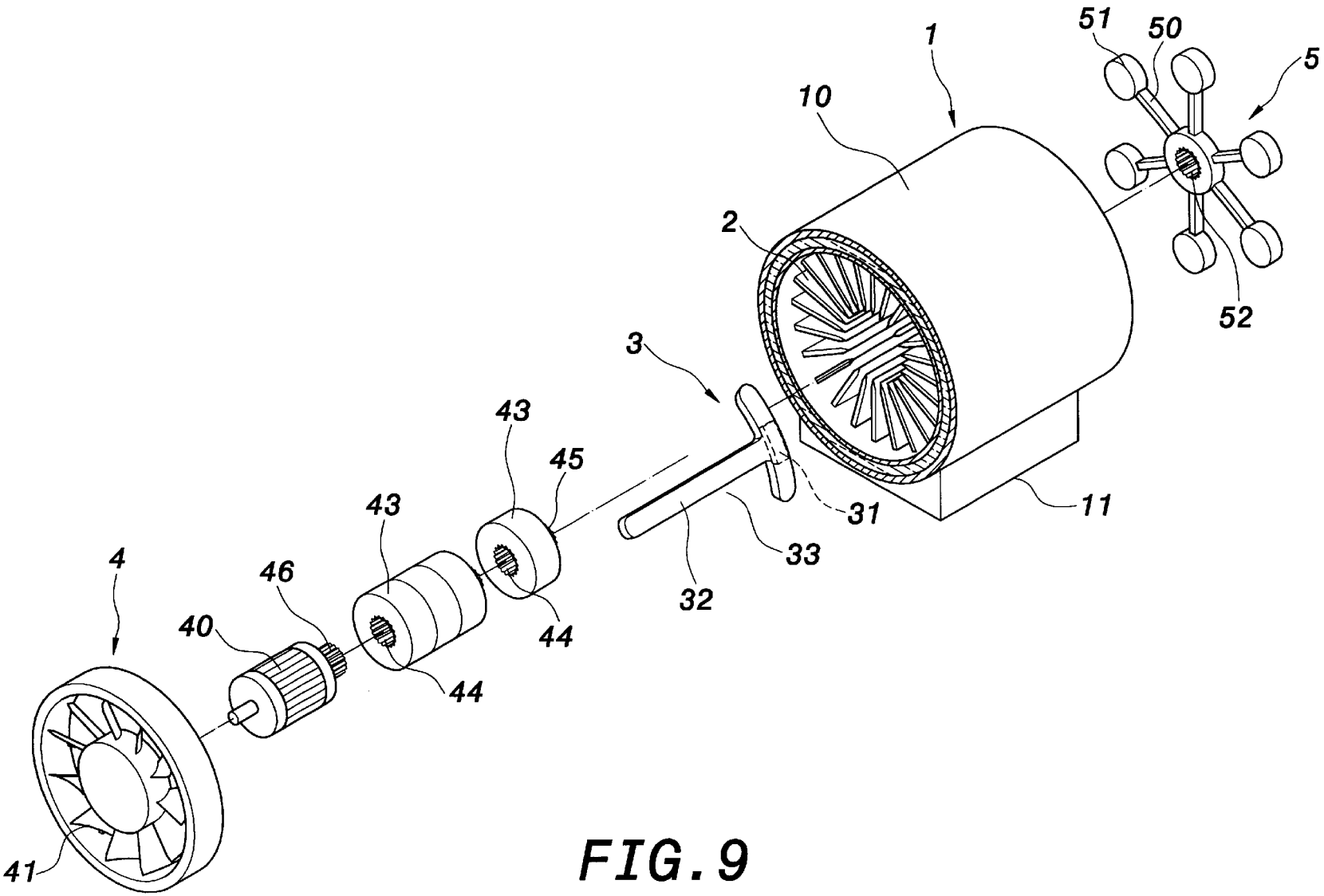
FIG. 9 is an exploded perspective view according to yet another embodiment of the present invention.

Please refer to FIGS. 8 and 9. The structure and shaped of hollow cavity 3 of the present invention can vary according to necessity. The number of the rod bodies 32 can also increase or decrease according to necessity.

Besides, as shown in FIG. 9, the motor 40 of the present invention can be connected to the magnetic windmill 5 via a plurality of transmission wheels 43. The transmission wheels 43 are circular wheels, each having a perforation 44 at the center thereof. One end of the transmission wheel 43 projects to form a gear 45. The transmission wheels 43 connected with the perforations 44 and the gears 45 mutually meshing together. The perforation 44 of the transmission wheel 43 at one end meshes a gear 46 of the motor 40 for power output. The gear 45 of the transmission wheel 43 at the other end meshes a perforation 52 preset at the center of the magnetic windmill 5. The center of the magnetic windmill 5 can thus be connected to the motor 40 so that the motor 40 can drive the magnetic windmill 5 to rotate.

In addition to being driven by the motor 40, the magnetic windmill 5 of the present invention can also be driven by wind force or other appropriate ways. Airflow generated when the blades 41 of the fan 4 rotate is used to drive the magnetic windmill 5 to rotate.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A magnetic-levitated cooling circulatory mechanism, comprising:

an outer ring heat spreader having a hollow position therein;

a plurality of heat-radiating fins situated inside said outer ring heat spreader;

a magnetic hollow cavity capable of slidably rotating at said hollow position in said outer ring heat spreader; and a magnetic windmill placed at one end of said outer ring heat spreader and driven to rotate by a power source;

whereby when said magnetic windmill rotates, said magnetic hollow cavity can be driven to rotate through magnetic attraction between said magnetic windmill and said magnetic hollow cavity so as to quickly transfer heat source, hence achieving heat-radiating function of compulsory flow of fluid.

2. The magnetic-levitated cooling circulatory mechanism as claimed in claim 1, wherein said outer ring heat spreader comprises a seat bottom face and an annular wall, an inner edge of said annular wall having a hollow receiving space, which penetrates to two ends of said outer ring heat spreader, and said heat-radiating fins are situated in said receiving space of said outer ring heat spreader.

3. The magnetic-levitated cooling circulatory mechanism as claimed in claim 1, wherein said hollow position of said outer ring heat spreader can be filled with material of good heat conductance or cooling liquid.

4. The magnetic-levitated cooling circulatory mechanism as claimed in claim 1, wherein heat-spreading pipes are connected at two end of said outer ring heat spreader.

5. The magnetic-levitated cooling circulatory mechanism as claimed in claim 1, wherein a fan is disposed at the other end of said outer ring heat spreader.

6. The magnetic-levitated cooling circulatory mechanism as claimed in claim 1, wherein a center of said magnetic windmill is connected to a pivot of a motor, and said motor is used as the power source.

7. The magnetic-levitated cooling circulatory mechanism as claimed in claim 1, wherein a center of said magnetic windmill is connected to a transmission wheel, and said motor is used as the power source.

8. The magnetic-levitated cooling circulatory mechanism as claimed in claim 1, wherein said heat-radiating fins project from an inner wall of said outer ring heat spreader and radially gather together to a center of said outer ring heat spreader.

9. The magnetic-levitated cooling circulatory mechanism as claimed in claim 1, wherein a plurality of magnets are disposed at one end of said hollow cavity, said magnetic windmill has a plurality of blades, each having a magnet thereon, and said magnets on said blades correspond to said magnets of said hollow cavity.

10. The magnetic-levitated cooling circulatory mechanism as claimed in claim 1, wherein said hollow cavity has one or a plurality of rod bodies having stirring function.

* * * * *